US012655558B2

(12) United States Patent
Chen

(10) Patent No.: US 12,655,558 B2
(45) Date of Patent: Jun. 16, 2026

(54) THREAD-CUTTING MECHANISM OF AN EMBROIDERY MACHINE AND TUBE EMBROIDERY MACHINE APPLYING THE SAME

(71) Applicant: ZHEJIANG HEHE ELECTRIC MACHINERY CO., LTD, Shaoxing (CN)

(72) Inventor: Zhengan Chen, Shaoxing (CN)

(73) Assignee: ZHEJIANG HEHE ELECTRIC MACHINERY CO., LTD, Shaoxing (CN)

( * ) Notice: Subject to any disclaimer, the term of this patent is extended or adjusted under 35 U.S.C. 154(b) by 0 days.

(21) Appl. No.: 19/012,906

(22) Filed: Jan. 8, 2025

(65) Prior Publication Data

US 2025/0230592 A1 Jul. 17, 2025

(30) Foreign Application Priority Data

Jan. 11, 2024 (CN) ..... 202420080943.9
Jan. 11, 2024 (CN) ..... 202420083622.4

(51) Int. Cl.
*D05C 11/20* (2006.01)
*D05C 11/18* (2006.01)

(52) U.S. Cl.
CPC ..... *D05C 11/20* (2013.01); *D05C 11/18* (2013.01)

(58) Field of Classification Search
CPC ..... D05C 11/20; D05C 11/18; D05B 65/00; D05B 65/003; D05B 65/02
See application file for complete search history.

(56) References Cited

U.S. PATENT DOCUMENTS 3,605,664 A * 9/1971 Hedegaard ..... D05B 65/00 112/292
3,728,978 A * 4/1973 Honda ..... D05B 65/00 112/297
4,098,208 A * 7/1978 Hedegaard ..... D05B 65/00 112/300
4,437,423 A * 3/1984 Yamazawa ..... D05B 65/00 112/292
5,009,177 A * 4/1991 Sato ..... D05B 65/02 112/296
6,516,735 B2 * 2/2003 Hintzen ..... D05B 65/02 112/298
8,069,799 B2 * 12/2011 Tseng ..... D05B 65/02 112/292

* cited by examiner

*Primary Examiner* — Danny Worrell

(57) ABSTRACT

A thread-cutting mechanism of an embroidery machine, and a tube embroidery machine applying the same are provided. A movable knife frame provided at a periphery of a rotary shuttle can drive a movable knife to rotate around the rotary shuttle and coordinate with a stationary knife to cut a thread. The movable knife frame is rotatably provided at a periphery or one side of a driving shaft of the rotary shuttle. The movable knife frame is rotatably mounted on a needle plate seat, or on an embroidery machine body, at a corresponding location for cooperation with the rotary shuttle. The stationary knife is mounted on the needle plate seat, or on the embroidery machine body, at a corresponding location for cooperation with the rotary shuttle. This substantially reduces the space occupied by the movable knife. The thread-cutting mechanism is more compact, simple, compatible, and easy to use.

15 Claims, 16 Drawing Sheets

THREAD-CUTTING MECHANISM OF AN EMBROIDERY MACHINE AND TUBE EMBROIDERY MACHINE APPLYING THE SAME

CROSS REFERENCE TO RELATED APPLICATIONS

The present application claims the benefit of Chinese Patent Application Nos. 2024200836224 and 2024200809439 filed on Jan. 11, 2024. All the above are hereby incorporated by reference in their entirety.

TECHNICAL FIELD

The present application relates to the technical field of embroidery machines, in particular to a thread-cutting mechanism of an embroidery machine and a tube embroidery machine applying the same.

BACKGROUND TECHNOLOGY

The existing embroidery machine is usually provided on the top of a rotary shuttle with a movable knife that is rotatable in a plane and cooperates with a stationary knife to cut threads. The movable knife rotating in a plane needs to occupy a larger space, so as to have sufficient cooperation enabling the movable knife to rotate and cooperate with or separate from the stationary knife. This increases the volume of the needle plate seat. Due to the planar knife and the driving of it, the lower end face of the needle plate is flat. This also increases the occupancy of the needle plate.

In addition, the existing thread-cutting drive structure uses a motor and a swing rod for transmission, which is more complex and inconvenient to assemble and disassemble. The thread hook, the planar knife, its horizontal placement, and the driving of it cause a larger occupation of the needle plate seat at the front end of the shuttle box as well as the cross-section of the front portion of the shuttle box. Due to the planar knife and the driving of it, it is necessary to set up a larger plane space inside and outside the needle plate seat. This increases the processing costs and also increases the occupancy of the needle plate.

SUMMARY

In order to solve the above defects of the existing technology, the present application provides a thread-cutting mechanism of an embroidery machine. The movable knife frame is mounted coaxially with the rotary shuttle. The arc surface of the movable knife is parallel to the arc surface of the periphery of the rotary shuttle. The space around the rotary shuttle is reasonably used to save space.

The technical scheme adopted is as follows:

A thread-cutting mechanism of an embroidery machine, as an improvement, includes a movable knife provided at a periphery of a rotary shuttle and a stationary knife cooperating with the movable knife for cutting a thread, the movable knife is provided on a movable knife frame that drives the movable knife to rotate around the rotary shuttle and cooperate with the stationary knife to cut the thread, the movable knife frame is rotatably provided at a periphery or one side of a driving shaft of the rotary shuttle; the movable knife frame is rotatably mounted on a needle plate seat, or on an embroidery machine body, at a corresponding location for cooperation with the rotary shuttle; the stationary knife is mounted on the needle plate seat, or on the embroidery machine body, at a corresponding location for cooperation with the rotary shuttle.

As a further improvement, the movable knife frame is provided with a drive structure that drives the movable knife frame to rotate; a thread-guiding opening is provided on the movable knife; the thread-separating plate is set as an arc-shaped thread-separating plate that cooperates with the rotary shuttle.

As a further improvement, the needle plate seat is mounted on a front end face of a shuttle box of the embroidery machine body; the needle plate seat is further provided with a thread-separating plate, the thread-separating plate is disposed outside an arc surface of the periphery of the rotary shuttle.

As a further improvement, the movable knife frame is rotatably mounted on the needle plate seat; the needle plate seat is extended and provided with a seat frame, the stationary knife is provided on the seat frame.

As a further improvement, the movable knife or/and the stationary knife are arc-shaped knives that cooperate with the rotary shuttle.

As a further improvement, the movable knife frame is concentrically disposed with a coaxial center of the rotary shuttle, the movable knife frame is provided with a mounting hole that allows the driving shaft of the rotary shuttle to pass through and rotate relatively.

As a further improvement, an arc of the movable knife or/and the stationary knife is concentric with the driving shaft of the rotary shuttle.

As a further improvement, the movable knife frame is provided with a connecting wheel that drives the movable knife frame to rotate.

As a further improvement, the needle plate seat is provided thereon with a mounting hole for mounting the movable knife frame, the movable knife frame includes a connecting wheel provided with a connecting handle, and a connecting annular groove that is rotatably provided in the mounting hole, and the movable knife is provided on the connecting handle.

As a further improvement, the connecting wheel is provided with a driving gear. The needle plate seat is provided thereon with a detector that detects a rotating position of the movable knife.

A tube embroidery machine that applies any one of the above thread-cutting mechanisms of an embroidery machine includes a shuttle box, a needle plate seat mounted on the shuttle box, a rotary shuttle provided in the needle plate seat, a periphery of a rotary shuttle is mounted with a movable knife and a stationary knife cooperating with the movable knife for cutting a thread, the movable knife is provided on a movable knife frame that drives the movable knife to rotate around the rotary shuttle and cooperate with the stationary knife to cut the thread, the movable knife frame is rotatably provided at a periphery or one side of a driving shaft of the rotary shuttle; the movable knife frame is rotatably mounted on a needle plate seat, or on an embroidery machine body, at a corresponding location for cooperation with the rotary shuttle; the stationary knife is mounted on the needle plate seat, or on the embroidery machine body, at a corresponding location for cooperation with the rotary shuttle; and the movable knife frame is provided with a drive structure that drives the movable knife frame to rotate.

As a further improvement, the drive structure includes a transmission shaft that drives the movable knife frame to rotate, and a drive motor that drives the transmission shaft. The drive motor is provided on one side of the shuttle box.

As a further improvement, a first transmission structure is provided between the transmission shaft and the drive motor; or/and a second transmission structure is provided between the transmission shaft and the movable knife frame.

As a further improvement, the first transmission structure includes a first gear set or a first transmission belt and pulley assembly; the second transmission structure includes a second gear set or a second transmission belt and pulley assembly.

As a further improvement, the transmission shaft cooperates with the connecting wheel provided by the movable knife frame to drive the movable knife frame.

As a further improvement, the first transmission structure includes a synchronous belt and pulley assembly provided between the drive motor and the transmission shaft.

Compared with the existing technology, the beneficial effects of the present application are that:

A periphery of the rotary shuttle is provided with a movable knife frame that drives a movable knife to rotate around the rotary shuttle and coordinate with a stationary knife to cut a thread. The movable knife frame is rotatably provided at a periphery or one side of a driving shaft of the rotary shuttle. The movable knife frame is rotatably mounted on a needle plate seat, or on an embroidery machine body, at a corresponding location for cooperation with the rotary shuttle. The stationary knife is mounted on the needle plate seat, or on the embroidery machine body, at a corresponding location for cooperation with the rotary shuttle. By rotating the movable knife frame to drive the movable knife around the rotary shuttle in cooperation with the stationary knife to cut threads, the occupied volume of the movable knife can be significantly reduced. The movable knife frame that rotates around the rotary shuttle avoids the need of a power conversion structure for the movable knife in the transmission plane due to the difference between the direction of rotation and the direction of the driving shaft. The transmission structure can be greatly simplified. The structure for the movement of the movable knife and the driving of the movable knife can also be simplified, and its size can be reduced. The bottom portion of the needle plate can be set to an arc shape. The thickness of the needle plate can also be reduced, so that the structures of the movable knife, the needle plate seat, and the needle plate are more compact.

The structure of the present application can be used in tube embroidery machines, cap embroidery machines, or ordinary flat embroidery machines. The structural installation method of the present application can effectively utilize the space around the rotary shuttle. It is convenient to use. It saves space, reduces the size of the needle plate seat, and has greater compatibility.

Figure 1:
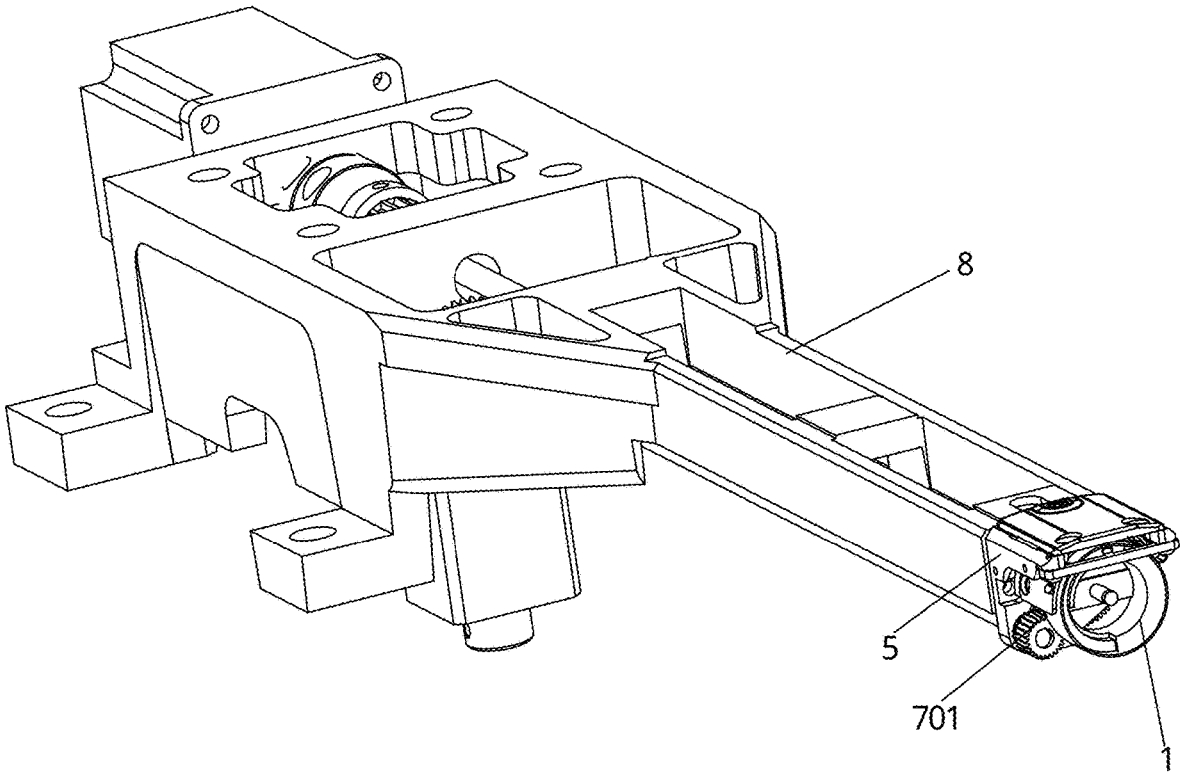
FIG. 1 is a schematic diagram of the overall structure of the present application.
Figure 2:
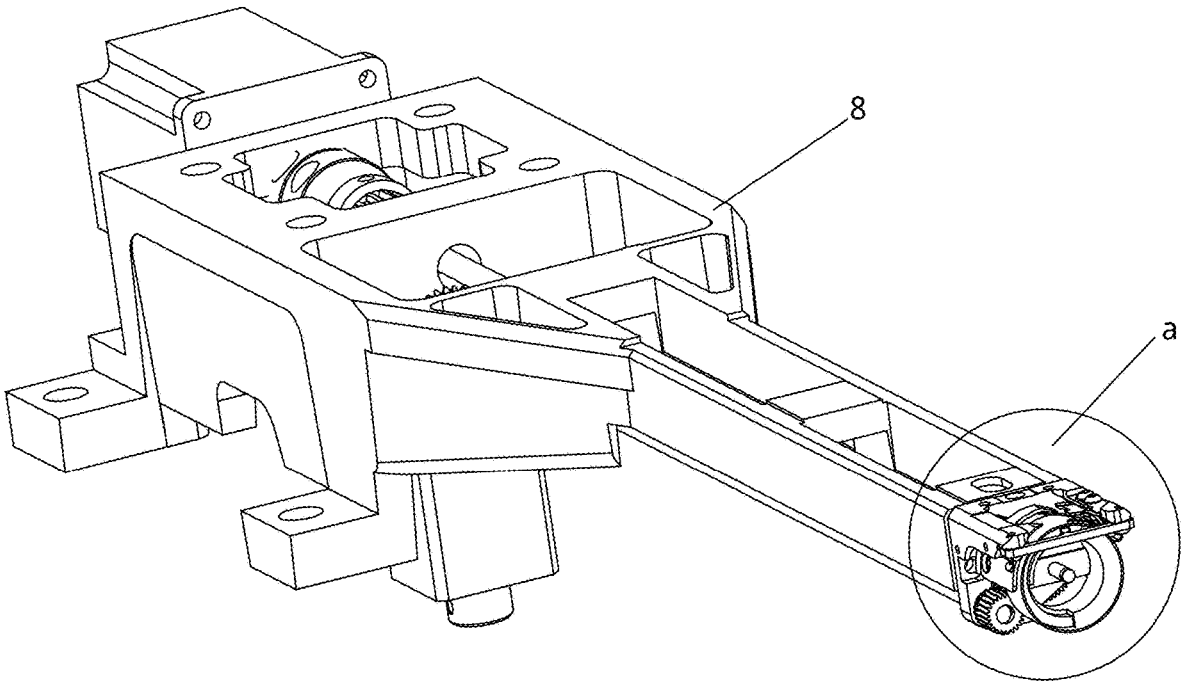
FIG. 2 is a schematic diagram of a part of the structure of the present application.
Figure 3:
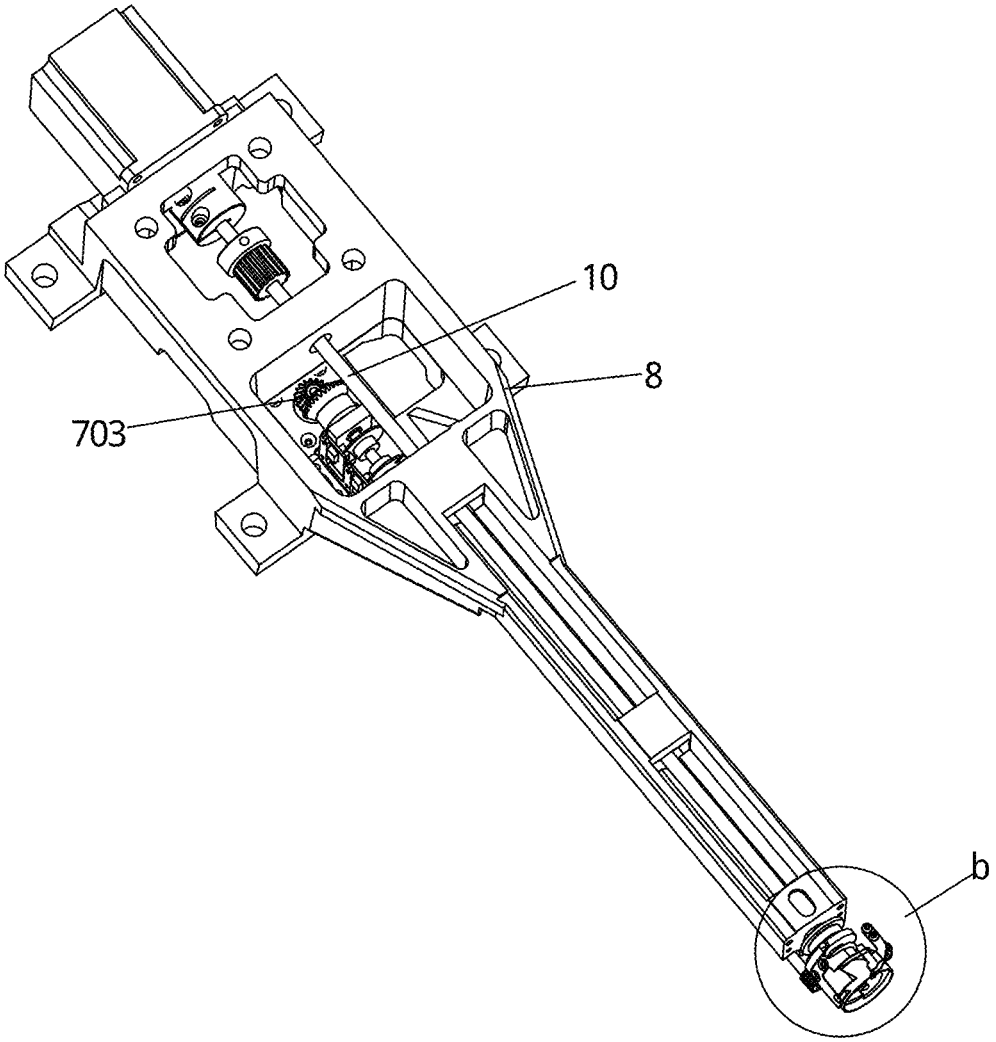
FIG. 3 is a top view of the present application.
Figure 4:
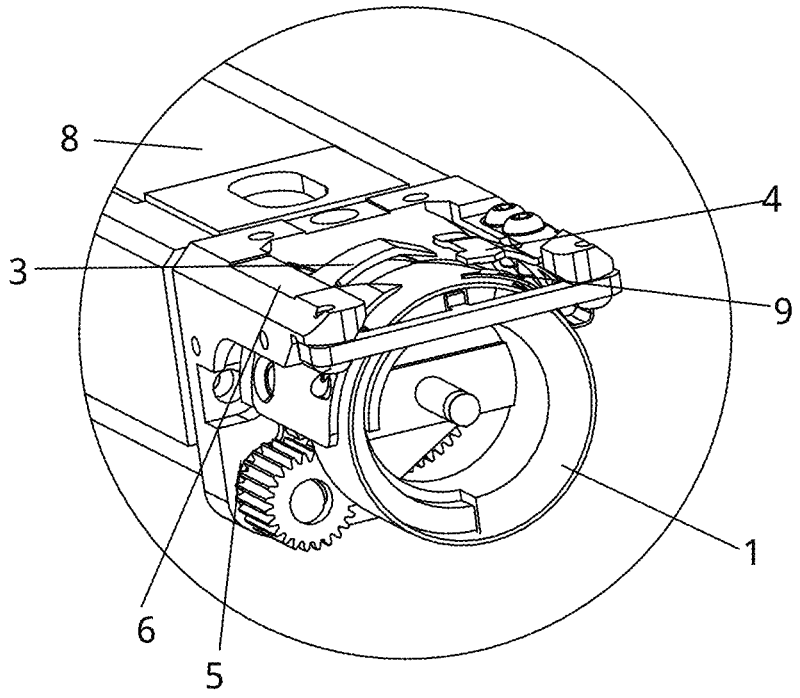
FIG. 4 is an enlarged view at a of FIG. 2.
Figure 5:
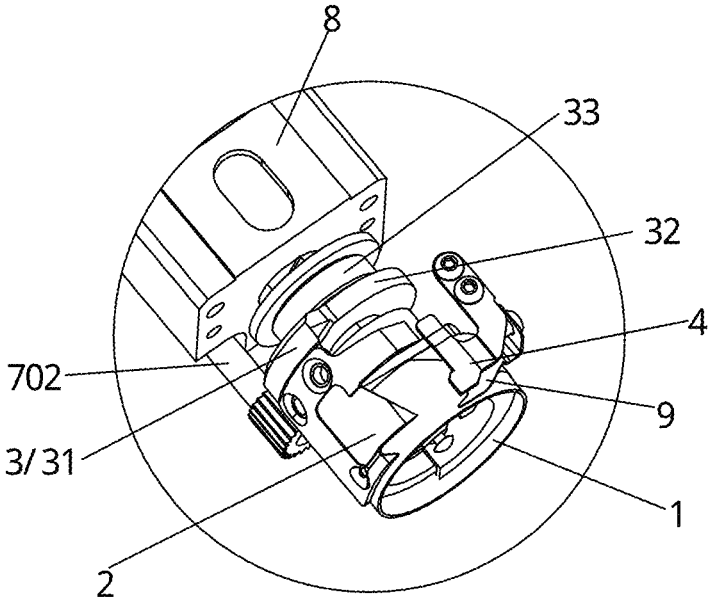
FIG. 5 is an enlarged view at b of FIG. 3.
Figure 6:
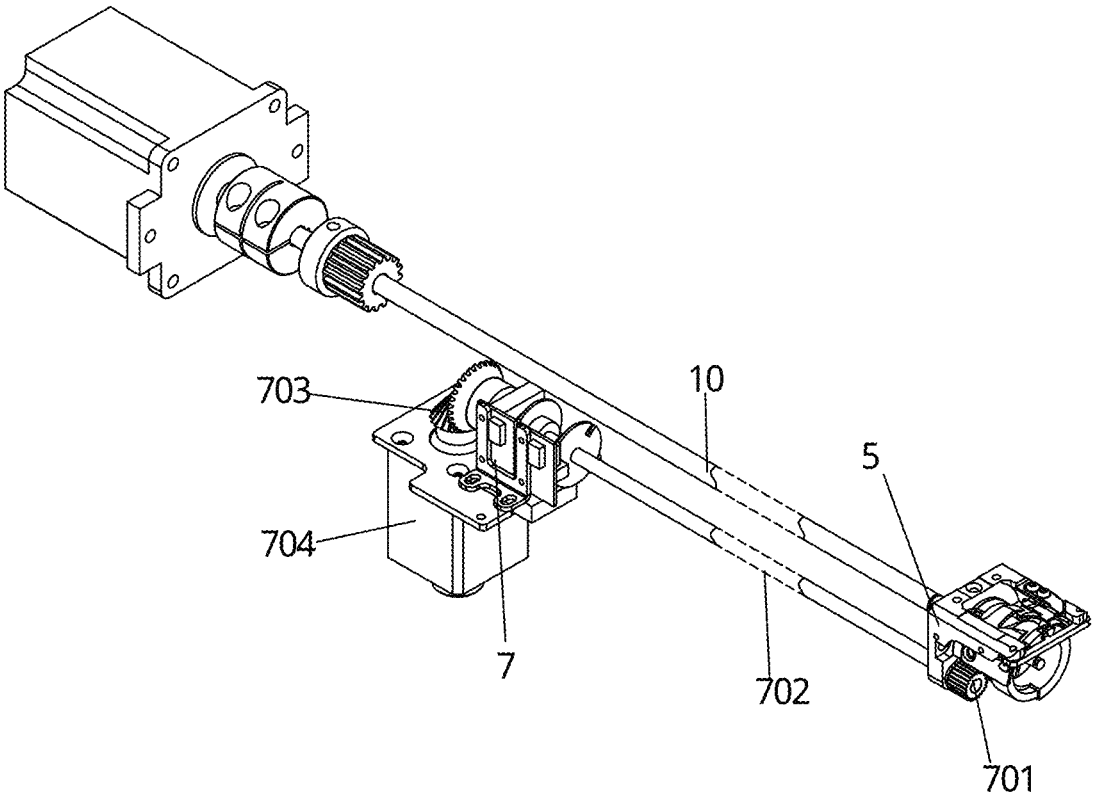
FIG. 6 is a schematic diagram of the drive structure of the present application.
Figure 7:
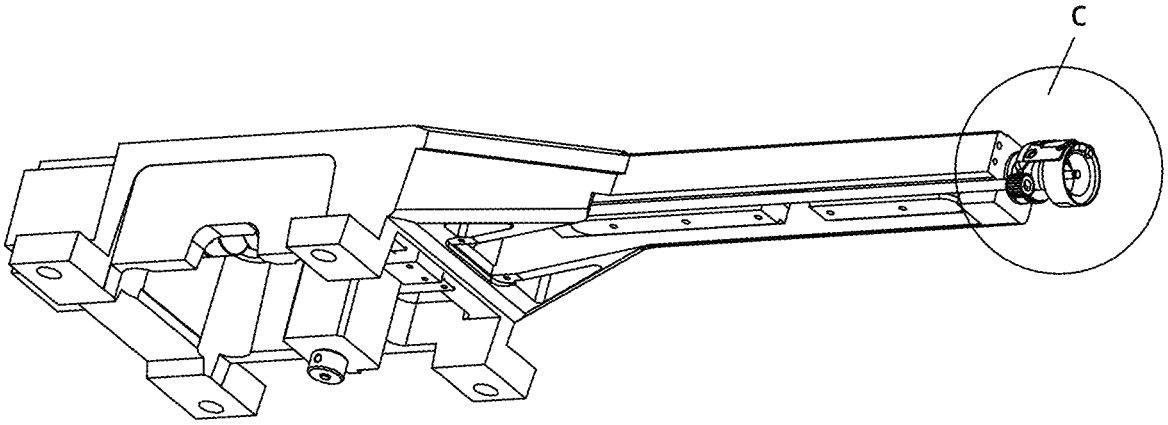
FIG. 7 is a bottom view of the present application.
Figure 8:
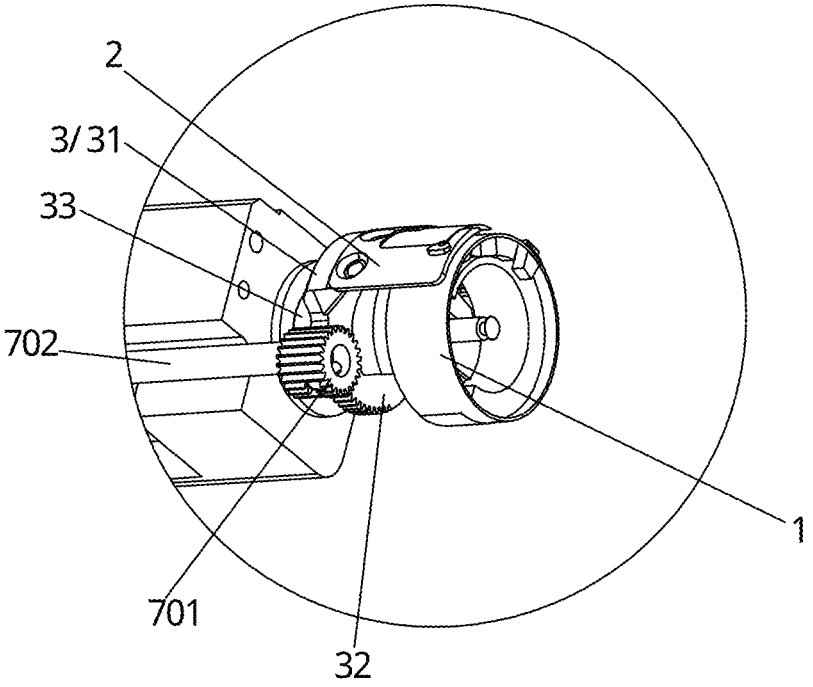
FIG. 8 is an enlarged view at c of FIG. 7.
Figure 9:
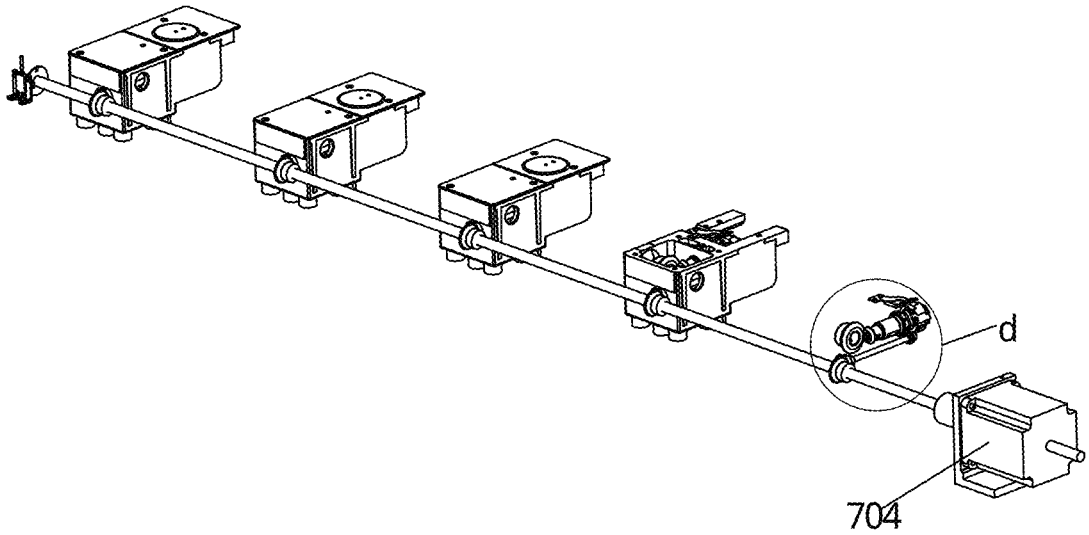
FIGS. 9-10 are schematic diagrams of the structure of the thread-cutting mechanism of the present application applied to flat embroidery.
Figure 10:
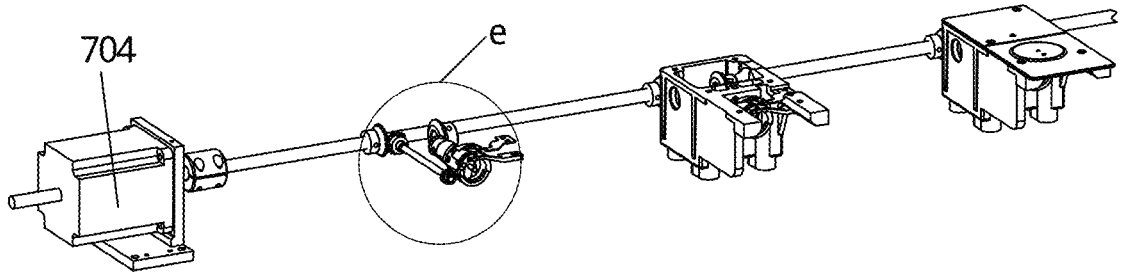
Figure 11:
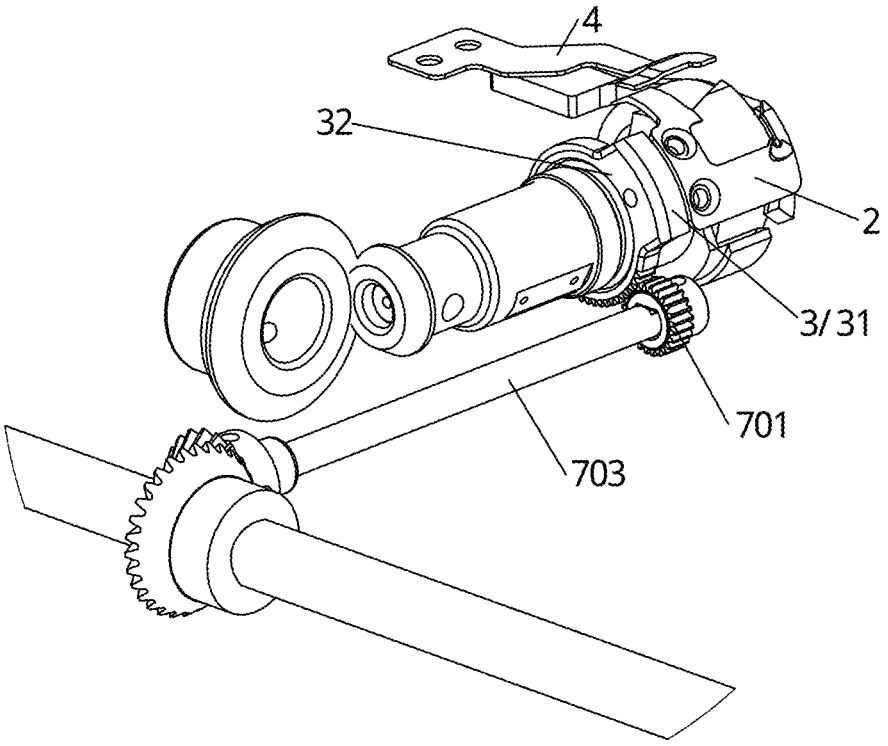
FIG. 11 is an enlarged schematic view at d of FIG. 9.
Figure 12:
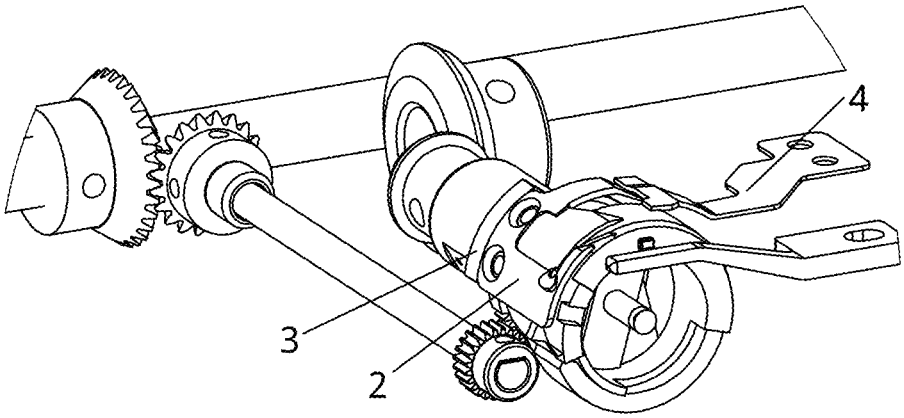
FIG. 12 is an enlarged schematic view at e of FIG. 10.

wherein, rotary shuttle 1, movable knife 2, movable knife frame 3, connecting handle 31, connecting wheel 32, connecting annular groove 33, stationary knife 4, needle plate seat 5, seat frame 6, drive structure 7, first transmission wheel 701, transmission shaft 702, second gear structure 703, drive motor 704, shuttle box 8, thread-separating plate 9, rotary shuttle driving shaft 10.

DETAILED EMBODIMENTS

The present application is further described below in conjunction with specific embodiments.

A thread-cutting mechanism of an embroidery machine includes a movable knife 2 provided at a periphery of a rotary shuttle 1 and a stationary knife 4 cooperating with the movable knife for cutting a thread. The movable knife 2 is provided on a movable knife frame 3 that drives the movable knife 2 to rotate around the rotary shuttle and cooperate with the stationary knife 4 to cut the thread. The movable knife frame 3 is rotatably provided at a periphery or one side of a driving shaft 10 of the rotary shuttle. That is, the movable knife frame 3 can be provided on any side of the driving shaft 10 of the rotary shuttle through a rotating shaft to facilitate the thread cutting position, or the movable knife frame 3 can be provided with a through-hole that can facilitate the driving shaft 10 of the rotary shuttle to pass through, so that the movable knife frame 3 can be rotatably provide at a periphery of the driving shaft 10 of the rotary shuttle. Specifically, the movable knife frame 3 is rotatably mounted on a needle plate seat 5, or on an embroidery machine body, at a corresponding location for cooperation with the rotary shuttle. The stationary knife 4 is mounted on the needle plate seat 5, or on the embroidery machine body, at a corresponding location for cooperation with the rotary shuttle. The movable knife frame 3 can be mounted on the needle plate seat 5 or at a corresponding location of the embroidery machine body according to the actual situation of the corresponding embroidery machine. For example, the movable knife frame 3 can be mounted on the shuttle box 8 of the embroidery machine body, and is located at a position where it matches with the rotary shuttle 1.

The needle plate seat 5 is mounted on a front end face of the shuttle box 8 of the embroidery machine body. The needle plate seat 5 is further provided with a thread-separating plate 9. The thread-separating plate 9 is disposed outside an arc surface of the periphery of the rotary shuttle. The thread-separating plate 9 is used for separating the threads during cutting of the threads. Due to the cooperation with the rotation of the movable knife 2, the thread-separating plate 9 can also be designed as an arc-shaped thread-separating plate that matches with the rotary shuttle 1, thereby also saving space.

A thread-guiding opening is provided on the movable knife 2. A bottom portion of a needle plate on the needle plate seat 5 is provided with an arc that matches with an arc shape of the movable knife 2. Usually, the upper surface of the needle plate for cap embroidery or tube embroidery is arc-shaped. Setting the bottom portion of the needle plate to an arc shape can reduce the thickness of the needle plate, so that the stationary knife 4, the movable knife frame 3, and the movable knife 2 are mounted and offset upwards. The height of the needle plate seat 5 can be reduced, so that the needle plate seat is more compact.

Referring to FIGS. 1-12, in the present embodiment, the movable knife frame 3 is rotatably mounted on the needle plate seat 5. The needle plate seat 5 is extended and provided with a seat frame 6. The stationary knife 4 is provided on the seat frame 6. The needle plate seat 5 is mounted on the shuttle box of the embroidery machine body at a corresponding location that matches with the rotary shuttle.

The shape of the movable knife 2 or/and the stationary knife can be determined according to the thread-cutting requirements and the ease of driving the thread-cutting process, with the specific shape being determined by what facilitates the thread-cutting. As a preferred embodiment, the movable knife 2 or/and the stationary knife are arc-shaped knives that match with the rotary shuttle. Arc-shaped knives allow the movable knife and the stationary knife to occupy a minimal amount of space. It is beneficial for the movable knife 2 to operate within a narrow space, and the stationary knife 4 can cooperate with the thread cutting. At the same time, as preferred, the movable knife frame 3 is concentrically disposed with a coaxial center of the rotary shuttle. The movable knife frame 3 is provided with a mounting hole that allows the driving shaft of the rotary shuttle to pass through and rotate relatively. This mounting hole is the through-hole described above. As a further preference, an arc of the movable knife 2 or/and the stationary knife is concentric with the driving shaft of the rotary shuttle. The above-mentioned concentric setting can be convenient for installation, and can also be beneficial to improve the accuracy of the movable knife 2.

Of course, the movable knife 2 or/and the stationary knife 4 can be optional set to be concentric with the driving shaft 10 of the rotary shuttle according to actual needs. The movable knife frame 3 can also be set to be non-concentric with the rotary shuttle according to actual needs. The rotating shaft of movable knife frame 3 can be provided on one side of the driving shaft 10 of the rotary shuttle.

The movable knife frame 3 is provided with a connecting wheel 32 that drives the movable knife frame 3 to rotate. The connecting wheel 32 is provided with a driving gear.

The needle plate seat 5 is provided thereon with a mounting hole for mounting the movable knife frame 3. The movable knife frame 3 includes a connecting wheel 32 provided with a connecting handle 31 and a connecting annular groove 33 that can be rotatably provided in the mounting hole, and the movable knife 2 is provided on the connecting handle. It can be directly positioned in the mounting hole of needle plate seat 5 through the connecting annular groove 33, and is rotatably connected with needle plate seat 5. Of course, it can also be connected with the mounting hole of needle plate seat 5 through bearings.

The movable knife frame 3 is provided with a drive structure 7 that drives the movable knife frame 3 to rotate. The drive structure 7 includes a first transmission wheel 701 that cooperates with a driving gear of the connecting wheel 32, and a second gear structure 703 connected with the first transmission wheel 701 through a transmission shaft 702. The second gear structure 703 is provided thereon with a drive motor 704. The drive motor 704 drives the second gear structure 703, and the second gear structure 703 drives the first transmission wheel 701 through the transmission shaft 702. The first transmission wheel 701 cooperates with the connecting wheel 32 through meshing teeth to drive the movable knife frame 3 to rotate and cut the thread.

Of course, the first transmission wheel 701 and the connecting wheel 32 can also be driven by a belt. In this preferred embodiment, gear transmission is used for the connecting wheel 32. The second gear structure 703 can be a bevel gear set.

The needle plate seat 5 is provided thereon with a detector that detects the rotating position of the movable knife. The detector is used for positioning of the movable knife 2, so that the movable knife 2 can better cooperate with the stationary knife 4 to cut the thread. A second mounting hole can be provided on a connecting plate of the needle plate seat 5 connected to the shuttle box 8. The detector can be provided in the second mounting hole. The second mounting hole can be provided at a periphery of the mounting hole of the movable knife frame 3. The detector can be used to work with an embroidery machine system or an independently set system. The zero position of the movable knife 2 is initially homed to facilitate control of the drive motor 704 by the embroidery machine system or the independently set system. The drive motor 704 drives the movable knife to start from the zero position and accurately coordinate with the stationary knife 4 to cut the thread. Alternatively, the detector detects the immediate position of the movable knife 2, thereby facilitating the control of the drive motor 704 by the embroidery machine system or the independently set system. The drive motor 704 drives the movable knife to accurately cooperate with the stationary knife 4 to cut the thread.

Referring to FIGS. 1-8, the movable knife frame 3, the movable knife 2, the stationary knife 4, and the thread-separating plate 9 of the thread-cutting mechanism of the present application are mounted in the needle plate seat 5, and mounted on a front end face of the shuttle box of the tube embroidery machine through the needle plate seat 5. The movable knife frame 3 is driven by the drive motor 704 to drive the movable knife 2 to cut the thread. In the thread-cutting mechanism of the tube embroidery machine of the present application, the cross-section of the front portion of the shuttle box can be reduced from the current 48 mm in width*49 mm in height to 44 mm in width*40 mm in height. After becoming smaller, it can be used for the embroidery of socks and shoe uppers.

Referring to FIGS. 9-12, the thread-cutting mechanism of the present application can be installed on a flat embroidery machine. The flat embroidery machine is provided with a plurality of shuttle boxes. The movable knife frame 3, the movable knife 2, the stationary knife 4, and the thread-separating plate 9 of the thread-cutting mechanism are mounted in the needle plate seat 5, and mounted on a front end face of the shuttle box of the flat embroidery machine through the needle plate seat 5. The drive motor 704 drives the movable knife frame 3 of the thread-cutting mechanism on each shuttle box through a driving shaft and a bevel gear set.

Figure 13:
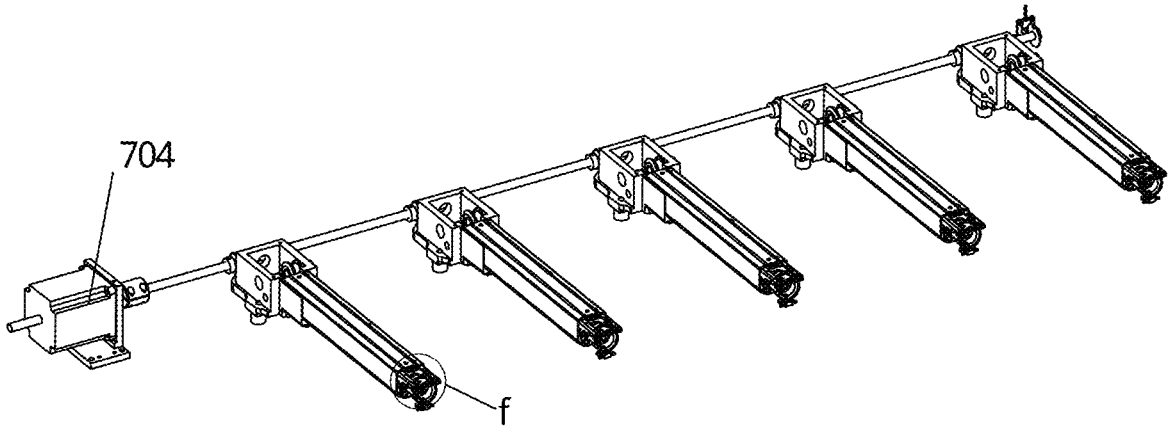
FIG. 13 is a schematic diagram of the structure of the thread-cutting mechanism of the present application applied to cap embroidery.
Figure 14:
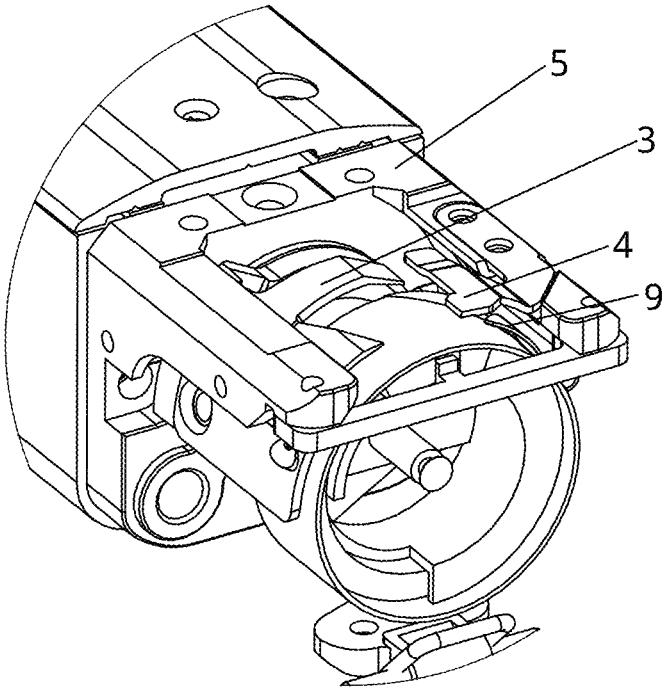
FIG. 14 is an enlarged schematic view at f of FIG. 13.

Referring to FIGS. 13-14, the thread-cutting mechanism of the present application can be installed on a cap embroidery machine. The cap embroidery machine is provided with a plurality of shuttle boxes. The movable knife frame 3, the movable knife 2, the stationary knife 4, and the thread-separating plate 9 of the thread-cutting mechanism are installed in the needle plate seat 5, and mounted on a front end face of the shuttle box of the cap embroidery machine through the needle plate seat 5. The drive motor 704 drives the movable knife frame 3 of the thread-cutting mechanism on each shuttle box through a driving shaft and a bevel gear set.

Referring to FIGS. 1-8, the present application further discloses a tube embroidery machine that applies any one of the above-mentioned thread-cutting mechanisms of an embroidery machine, which includes a shuttle box 8, a needle plate seat 5 mounted on the shuttle box 8, and a rotary shuttle 1 provided in the needle plate seat 5, characterized in that: a periphery of the rotary shuttle 1 is mounted with a movable knife 2 and a stationary knife 4 cooperating with the movable knife for cutting a thread. The movable knife 2 is provided on a movable knife frame 3 that drives the movable knife 2 to rotate around the rotary shuttle and cooperate with the stationary knife 4 to cut the thread. The movable knife frame 3 is rotatably provided at a periphery or one side of a driving shaft 10 of the rotary shuttle. The movable knife frame 3 is rotatably mounted on a needle plate seat 5, or on an embroidery machine body, at a corresponding location for cooperation with the rotary shuttle. The stationary knife 4 is mounted on the needle plate seat 5, or on the embroidery machine body, at a corresponding location for cooperation with the rotary shuttle. The movable knife frame 3 is provided with a drive structure 7 that drives the movable knife frame 3 to rotate. The cooperation relationship between the rotary shuttle 1, the movable knife 2, the stationary knife 4, the movable knife frame 3, the shuttle box 8, and the driving shaft 10 of the rotary shuttle, and the relationship with the drive structure can fully refer to any scheme of the aforementioned thread-cutting mechanisms of an embroidery machine.

Since a tube embroidery machine is usually equipped with a longer shuttle box 8, therefore the drive structure 7 usually includes a transmission shaft 702 that drives the movable knife frame 3 to rotate, and a drive motor 704 that drives the transmission shaft 702. The drive motor 704 can be provided at a corresponding location that is convenient for installment in a middle portion of the shuttle box 8. The drive motor 704 can be provided on an inner side of the shuttle box 8. As a preferred embodiment, the drive motor 704 is provided on one side of the shuttle case 8.

In order to adapt to different motor installation conditions, a first transmission structure is provided between the transmission shaft 702 and the drive motor 704, or/and a second transmission structure is provided between the transmission shaft 702 and the movable knife frame 3. The second transmission structure can be conveniently adapted to the transmission shaft 702 and the movable knife frame 3. In order to adapt to the structure of the embroidery shuttle box 8 and facilitate the driving of the movable knife frame 3, the transmission shaft 702 cooperates with the connecting wheel 32 provided by the movable knife frame 3 to drive the movable knife frame 3. The transmission shaft 702 avoids the driving shaft 10 of the rotary shuttle, and is provided on one side of the driving shaft 10 of the rotary shuttle. The transmission shaft 702 can be installed on the shuttle box 8 through bearings.

The first transmission structure includes a first gear set or a first transmission belt and pulley assembly, and the second transmission structure includes a second gear set or a second transmission belt and pulley assembly. The first and second transmission structures can entirely use the existing technical mechanism, such as the above-mentioned gear set, bevel gear set, synchronous belt and pulley assembly, etc.

Figure 15:
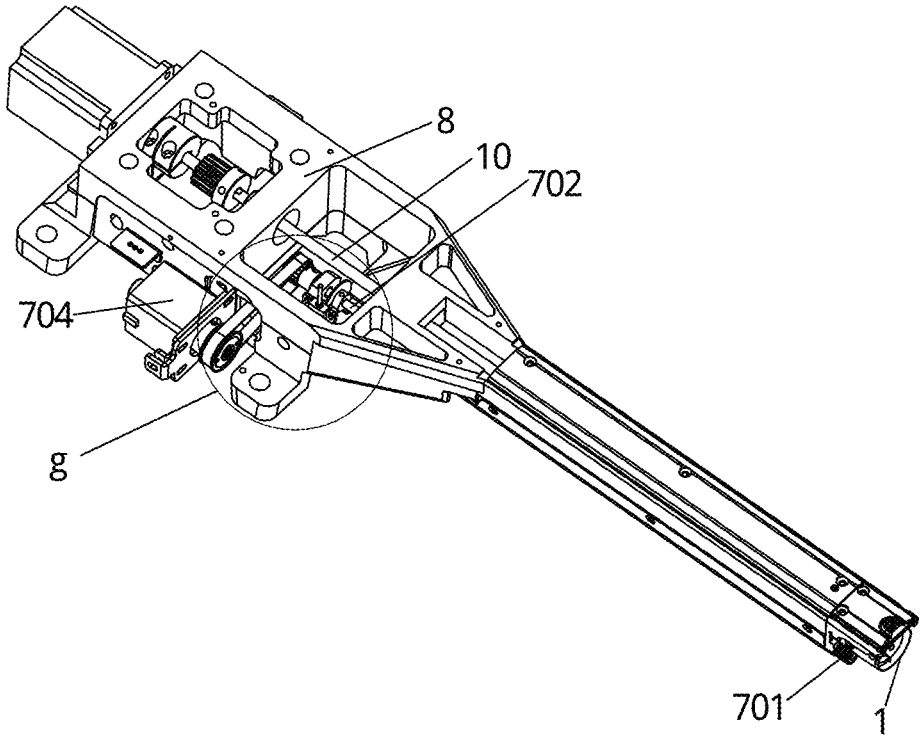
FIG. 15 is a schematic diagram of the structure of a tube embroidery machine of the present application.
Figure 16:
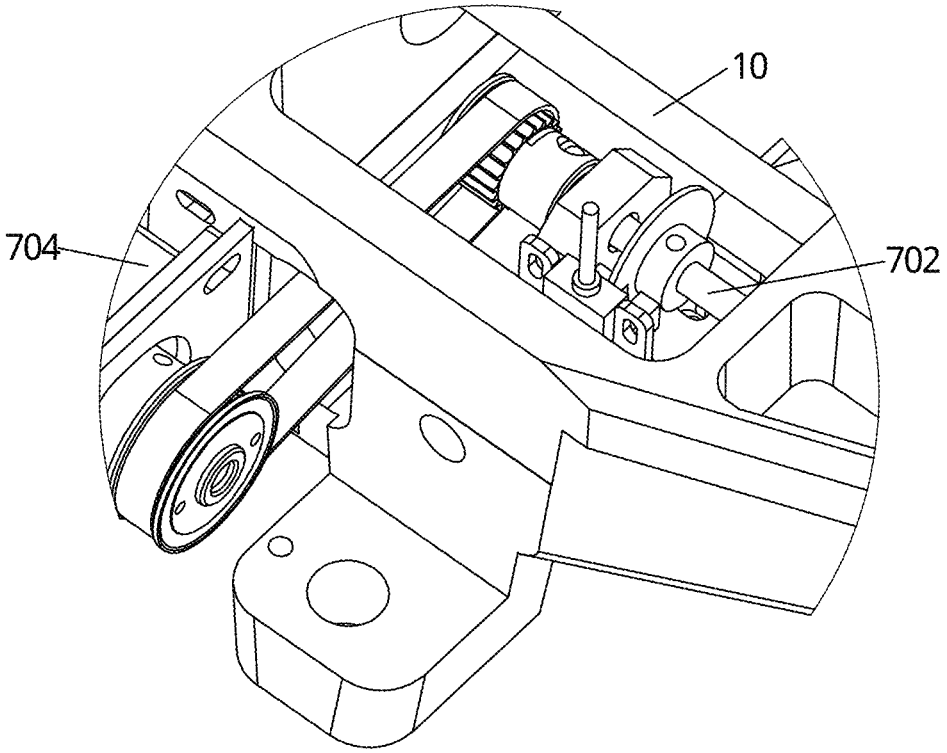
FIG. 16 is an enlarged schematic view at g of FIG. 15.

The first transmission structure can specifically use the above-mentioned second gear structure 703. The second transmission structure can specifically use the above-mentioned first transmission wheel 701. The first transmission wheel 701 cooperates with the driving gear on the connecting wheel 32 through meshing teeth to drive the movable knife frame 3 to rotate and cut the thread. As a preferred embodiment, referring to FIGS. 15-16, the first transmission structure includes a synchronous belt and pulley assembly provided between the drive motor 704 and the transmission shaft 702. The synchronous belt and pulley assembly has a good noise reduction effect.

What is claimed is:

1. A thread-cutting mechanism of an embroidery machine, comprising:

a movable knife (2) provided at a periphery of a rotary shuttle (1); and a stationary knife (4) cooperating with the movable knife for cutting a thread;

wherein the movable knife (2) is provided on a movable knife frame (3) that drives the movable knife (2) to rotate around the rotary shuttle and cooperate with the stationary knife (4) to cut the thread;

the movable knife frame (3) is rotatably provided at a periphery or one side of a driving shaft (10) of the rotary shuttle;

the movable knife frame (3) is rotatably mounted on a needle plate seat (5), or on an embroidery machine body, at a corresponding location for cooperation with the rotary shuttle;

the stationary knife (4) is mounted on the needle plate seat (5), or on the embroidery machine body, at a corresponding location for cooperation with the rotary shuttle; and the movable knife frame (3) is provided with a drive structure (7) that drives the movable knife frame (3) to rotate.

2. The thread-cutting mechanism as claimed in claim 1, wherein the needle plate seat (5) is mounted on a front end face of a shuttle box (8) of the embroidery machine body;

the needle plate seat (5) is further provided with a thread-separating plate (9), the thread-separating plate (9) is disposed outside an arc surface of the periphery of the rotary shuttle;

the thread-separating plate (9) is set as an arc-shaped thread-separating plate that cooperates with the rotary shuttle; and a thread-guiding opening is provided on the movable knife (2).

3. The thread-cutting mechanism as claimed in claim 1, wherein the movable knife frame (3) is rotatably mounted on the needle plate seat (5);

the needle plate seat (5) is extended and provided with a seat frame (6), the stationary knife (4) is provided on the seat frame (6); and the movable knife frame (3) is provided with a connecting wheel (32) that drives the movable knife frame (3) to rotate.

4. The thread-cutting mechanism as claimed in claim 1, wherein the movable knife (2) or/and the stationary knife have an arc shape that match with the rotary shuttle; and a bottom portion of a needle plate on the needle plate seat (5) is provided with an arc that matches with the arc shape of the movable knife (2).

5. The thread-cutting mechanism as claimed in claim 1, wherein the movable knife frame (3) is concentrically disposed with a coaxial center of the rotary shuttle, and the movable knife frame (3) is provided with a mounting hole that allows the driving shaft of the rotary shuttle to pass through and rotate relatively.

6. The thread-cutting mechanism as claimed in claim 4, wherein the arc shape of the movable knife (2) or/and the stationary knife is concentric with the driving shaft of the rotary shuttle.

7. The thread-cutting mechanism as claimed in claim 1, wherein the needle plate seat (5) is provided thereon with a mounting hole for mounting the movable knife frame (3), the movable knife frame (3) comprises a connecting wheel (32) provided with a connecting handle (31) and a connecting annular groove (33) that is rotatably provided in the mounting hole, and the movable knife (2) is provided on the connecting handle.

8. The thread-cutting mechanism as claimed in claim 7, wherein the connecting wheel (32) is provided with a driving gear.

9. The thread-cutting mechanism as claimed in claim 1, wherein the needle plate seat (5) is provided thereon with a detector that detects a rotating position of the movable knife.

10. A tube embroidery machine installed with the thread-cutting mechanism as claimed in claim 1, comprising:

a shuttle box (8), wherein the needle plate seat (5) is mounted on the shuttle box (8), and the rotary shuttle (1) is provided in the needle plate seat (5).

11. The tube embroidery machine as claimed in claim 10, wherein the drive structure (7) comprises a transmission shaft (702) that drives the movable knife frame (3) to rotate, and a drive motor (704) that drives the transmission shaft (702).

12. The tube embroidery machine as claimed in claim 11, wherein a first transmission structure is provided between the transmission shaft (702) and the drive motor (704); or/and a second transmission structure is provided between the transmission shaft (702) and the movable knife frame (3).

13. The tube embroidery machine as claimed in claim 12, wherein the first transmission structure comprises a first gear set or a first transmission belt and pulley assembly; the second transmission structure comprises a second gear set or a second transmission belt and pulley assembly; and the drive motor (704) is provided on one side of the shuttle box (8).

14. The tube embroidery machine as claimed in claim 11, wherein the transmission shaft (702) cooperates with the connecting wheel (32) provided by the movable knife frame (3) to drive the movable knife frame (3).

15. The tube embroidery machine as claimed in claim 12, wherein the first transmission structure comprises a synchronous belt and pulley assembly provided between the drive motor (704) and the transmission shaft (702).

* * * * *